US011650001B2

(12) United States Patent
Reynolds et al.

(10) Patent No.: US 11,650,001 B2
(45) Date of Patent: May 16, 2023

(54) UPRIGHT APPLIANCE DRAIN JUMPER

(71) Applicant: Electrolux Home Products, Inc., Charlotte, NC (US)

(72) Inventors: Matt Quintin Reynolds, Anderson, SC (US); Yousuf Ali Khan Mayanna, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/570,624

(22) Filed: Jan. 7, 2022

(65) Prior Publication Data

US 2022/0128288 A1 Apr. 28, 2022

Related U.S. Application Data

(63) Continuation of application No. 16/585,580, filed on Sep. 27, 2019, now Pat. No. 11,300,349.

(51) Int. Cl.
*F25D 21/14* (2006.01)

(52) U.S. Cl.
CPC ..... *F25D 21/14* (2013.01)

(58) Field of Classification Search
CPC ..... F25D 21/14; F25D 2321/14; F25D 2321/144; F25D 2321/146; F25D 2321/1411
See application file for complete search history.

(56) References Cited

U.S. PATENT DOCUMENTS

| | | | | |
|---|---|---|---|---|
| 1,235,304 | A | 7/1917 | Foster | |
| 1,504,126 | A | 10/1923 | Lassell | |
| 3,696,632 | A | 10/1972 | Carlin et al. | |
| 5,499,514 | A | 3/1996 | Ho | |
| 5,557,942 | A | 9/1996 | Kim et al. | |
| 6,672,094 | B1 | 1/2004 | Carden et al. | |
| 8,826,944 | B1 | 9/2014 | Laine | |
| 9,046,301 | B2 | 6/2015 | Park et al. | |
| 9,212,844 | B2 | 12/2015 | Lee et al. | |
| 9,863,689 | B2 | 1/2018 | Lee et al. | |
| 2006/0277934 | A1 | 12/2006 | Cho | |
| 2008/0047294 | A1* | 2/2008 | Hasegawa | F25D 31/005 62/412 |

(Continued)

FOREIGN PATENT DOCUMENTS

| | | |
|---|---|---|
| DE | 102010017919 | 10/2011 |
| EP | 0848217 | 6/1998 |

(Continued)

*Primary Examiner* — Elizabeth J Martin
(74) *Attorney, Agent, or Firm* — Pearne & Gordon LLP

(57) ABSTRACT

A drain extension assembly for an appliance that provides fluid communication between an internal storage compartment and an exterior environment via an appliance drain that collects and transfers liquid condensate from an evaporator. The drain extension assembly includes a main body with an inlet and an outlet. The inlet is configured to be secured to the appliance drain and the outlet is configured to be secured to an extension tube discharges the liquid condensate into a drain pan. A vacuum relief system provides selective fluid communication between the main body and the exterior environment. The vacuum relief system includes a pressure relief valve provided at a wall of the main body.

18 Claims, 8 Drawing Sheets

(56) References Cited

U.S. PATENT DOCUMENTS

| | | | | |
|---|---|---|---|---|
| 2010/0269531 | A1 | 10/2010 | Samdan et al. | |
| 2012/0117998 | A1 | 5/2012 | Yoo | |
| 2012/0131943 | A1 | 5/2012 | Shin | |
| 2012/0180514 | A1* | 7/2012 | Lee | F25D 17/047 62/291 |
| 2015/0121925 | A1 | 5/2015 | Park | |
| 2017/0045286 | A1 | 2/2017 | Ungor et al. | |

FOREIGN PATENT DOCUMENTS

| | | |
|---|---|---|
| FR | 2647193 | 11/1990 |
| WO | 2007023471 | 3/2007 |
| WO | 2009132940 | 11/2009 |

* cited by examiner

UPRIGHT APPLIANCE DRAIN JUMPER

CROSS-REFERENCE TO RELATED APPLICATIONS

This application is a continuation of U.S. application Ser. No. 16/585,580, filed on Sep. 27, 2019. This application is incorporated herein by reference.

FIELD OF THE INVENTION

The present application relates generally to an appliance drain of an appliance. More particularly, it relates to an appliance drain jumper assembly for a refrigerating appliance that can connect to an existing appliance drain and transfer drain water to a preferred location within a machine compartment.

BACKGROUND OF THE INVENTION

Conventionally, an appliance drain passes through an appliance cabinet near the rear of a machine compartment. The appliance drain carries water, such as melt water from an automatic defrost evaporator, outside of the chilled compartment. However, this conventional configuration makes it difficult for an operator to access the drain and connect a drain tube to transfer the drain water to a desired location, such as a drain pan under a condenser coil.

It is an objective of the present disclosure to alleviate or overcome one or more difficulties related to the prior art. It has been found that a new drain jumper assembly can be configured to allow an operator to connect a drain tube in an easily accessible location. Specifically, a drain jumper assembly can transfer drain water to a preferred location within the machine compartment. In a further embodiment, the drain jumper can swivel or rotate about the axis of the existing drain to further assist with easier assembly.

BRIEF SUMMARY OF THE INVENTION

In accordance with one aspect, there is provided a drain extension assembly for an appliance that provides fluid communication between an internal storage compartment and an exterior environment via an appliance drain that collects and transfers liquid condensate from an evaporator. The drain extension assembly includes a main body with an inlet and an outlet. The inlet is configured to be secured to said appliance drain and the outlet is configured to be secured to an extension tube that is configured to discharge said liquid condensate into a drain pan disposed below a condenser. A vacuum relief system is provided selective fluid communication between the main body and the exterior environment. The vacuum relief system includes a pressure relief valve provided at a wall of the main body.

In accordance with another aspect, there is provided an appliance including a cabinet defining a storage compartment. An evaporative cooling system is configured to reduce a temperature of the storage compartment, and includes an evaporator, a condenser, and a compressor. The evaporator is positioned within the storage compartment, and the condenser and compressor are positioned within a machine compartment located below and external to the storage compartment. The machine compartment is in fluid communication with an exterior environment. A drain is disposed below the evaporator to collect and transfer liquid condensate from the evaporator. The drain provides fluid communication between the storage compartment and the machine compartment. A drain extension assembly includes a main body having an inlet and an outlet. The inlet is secured to the drain at said machine compartment to receive the liquid condensate from the drain, and the outlet is secured to an extension tube that discharges said liquid condensate into a drain pan. A vacuum relief system provides selective fluid communication between the main body and the exterior environment. The vacuum relief system includes a pressure relief valve provided at a wall of the main body.

In accordance with a further aspect, there is provided a drain extension assembly for an appliance that provides fluid communication between an internal storage compartment and an exterior environment via an appliance drain that collects and transfers liquid condensate from an evaporator. The drain extension assembly includes a main body defining an interior and having an inlet and an outlet in fluid communication with said interior. The inlet is configured to be secured to said appliance drain and the outlet is configured to be secured to an extension tube that is configured to discharge said liquid condensate into a drain pan disposed below a condenser. The main body further includes an opening formed in a wall thereof. A vacuum relief system provides selective fluid communication between the main body and the exterior environment. The vacuum relief system includes a pressure relief valve provided at a wall of the main body. The pressure relief valve includes a door disposed within the interior and movably secured to the main body so as to selectively close the opening in order to automatically equalize a pressure differential between the interior of the main body and the exterior environment. The door includes a planar outer flange configured to rest against an interior surface of the wall of the main body. A projection is configured to be received within the opening when the outer flange rests against the interior surface of the wall so as to close the opening. The outer flange circumscribes the projection. Further, a pair of opposing projections extend peripherally outwards from the outer flange. Each projection of the pair of opposing projections is received within a respective cavity provided within the interior of the main body such that the door is pivotably secured to the main body.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION OF PREFERRED EMBODIMENTS

Figure 1:
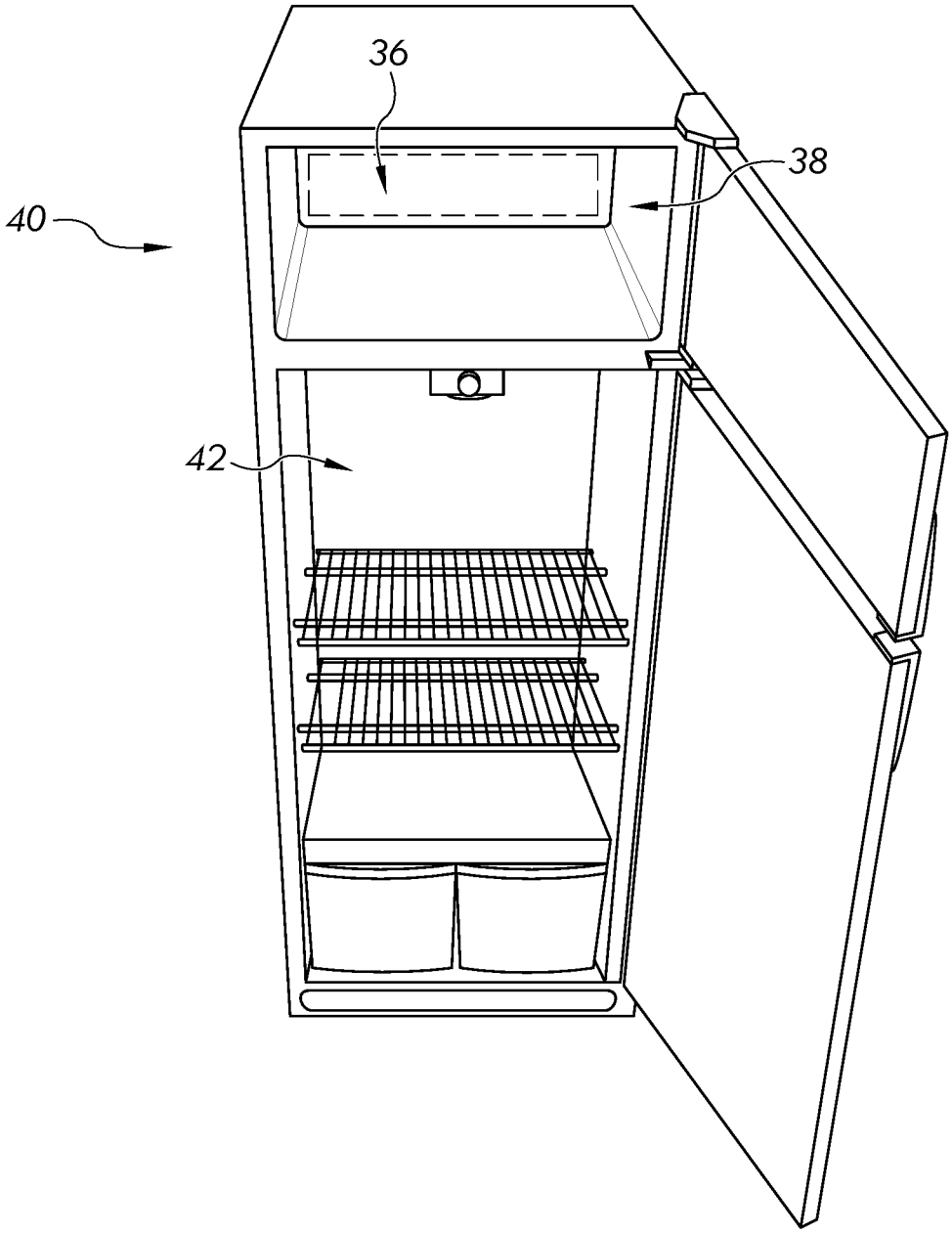
FIG. 1 is a front perspective view of an example top-mount refrigeration appliance.

Example embodiments are described and illustrated in the drawings. These illustrated examples are not intended to be limiting. For example, one or more aspects or features from each embodiment can be combined with or utilized in other embodiments.

Herein, when a range such as 5-25 (or 5 to 25) is given, this means preferably at least 5 and, separately and independently, preferably not more than 25. In an example, such a range defines independently at least 5, and separately and independently, not more than 25.

Referring now to the drawings, FIG. 1 shows a refrigeration appliance in the form of a top-mount refrigerator, indicated generally at 40, having a cabinet that includes a freezer compartment 38 located vertically-above a fresh food compartment 42. Although the detailed description that follows is described with reference to a top-mount refrigerator 40, other refrigeration appliance configurations can be utilized, e.g., a single door upright refrigerator or freezer, a bottom-mount refrigerator (i.e., the freezer is located vertically-below the fresh food compartment), a French-door bottom-mount refrigerator (i.e., a bottom-mount refrigerator that includes adjacent "French" style doors), a side-by-side refrigerator (i.e., the freezer compartment is on one side and the fresh food compartment is on the other side, opposite of the freezer compartment), etc.

Figure 2:
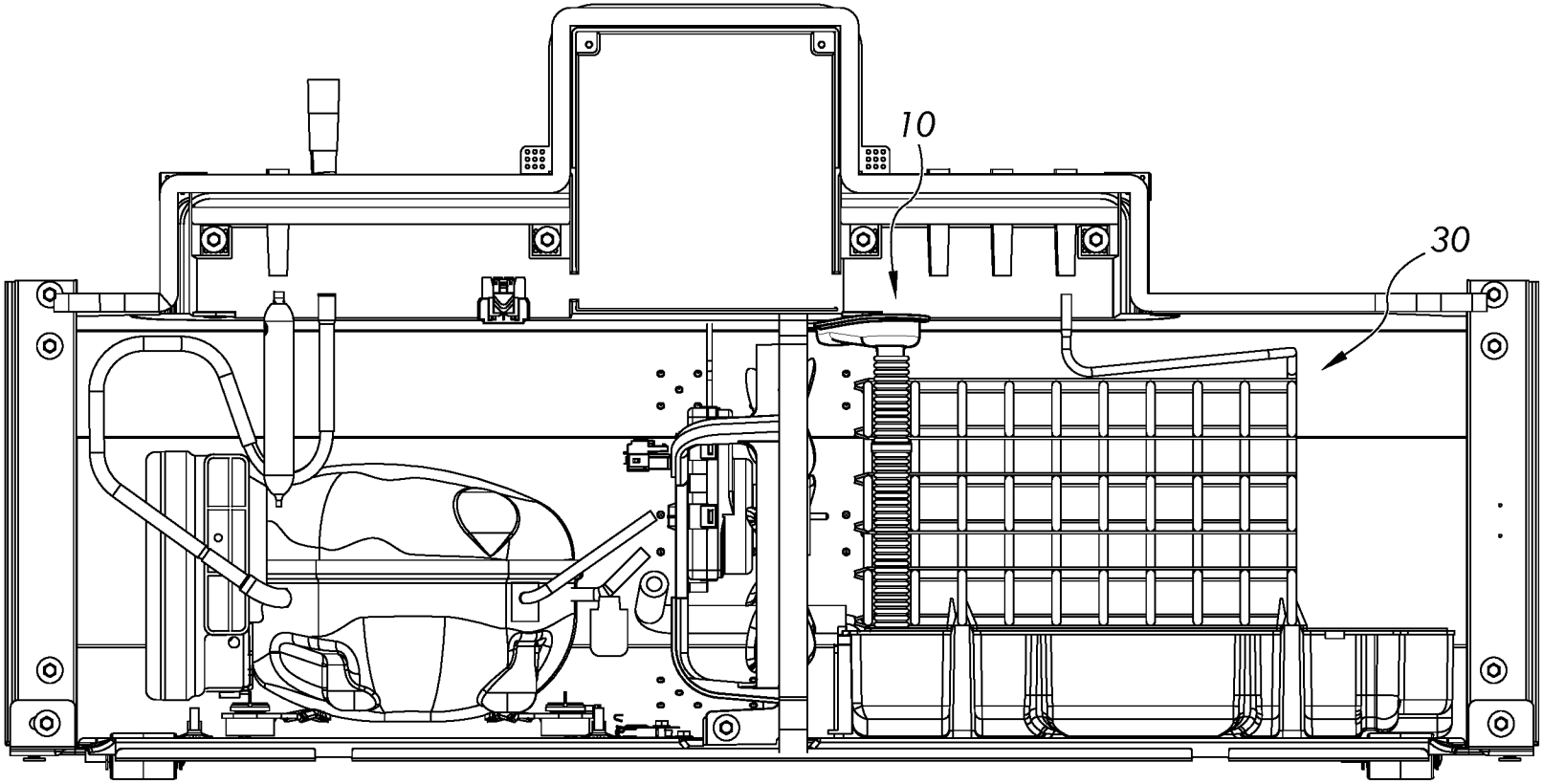
FIG. 2 is a front view of a machine compartment located at a rear of the refrigeration appliance, with an example drain jumper assembly.

The freezer compartment 38 of the appliance 40 is used to freeze and/or maintain articles of food in a frozen condition. For this purpose, the freezer compartment 38 is in thermal communication with a freezer evaporator 36, which is located in the rear of the appliance and in between the cabinet and exterior walls. The evaporator 36 removes thermal energy from the freezer compartment 38 to maintain a temperature of 0° C. or less during operation of the refrigerator 40. The removal of thermal energy from the freezer compartment results in condensation build-up around the evaporator coils (not shown), which can form frost or ice that is periodically removed by a defrost operation. During the defrost operation, an electric heater is operated to raise the temperature of the evaporator coils to melt the frost or ice into water condensate. This condensate drips from the evaporator 36, to a drain 28 (shown in FIG. 4) that is in fluid communication with a machine compartment 30 (shown in FIGS. 2-4). The machine compartment 30 is typically located external to the cooled compartments 38, 42, and contains the operative elements of the evaporative cooling system (e.g., the compressor, the condenser, the condenser fan, etc.). Other evaporators, such as a fresh food evaporator or an ice maker evaporator, may be employed in similar defrost conditions that generate melt water to be removed from the appliance. FIG. 2 is a front view of a machine compartment located at a rear of the refrigeration appliance, with an example drain jumper assembly according to the instant application. The drain jumper assembly 10 transfers the drain water from the drain 28 to a more easily accessible location for an operator, as discussed in more detail below.

Figure 4:
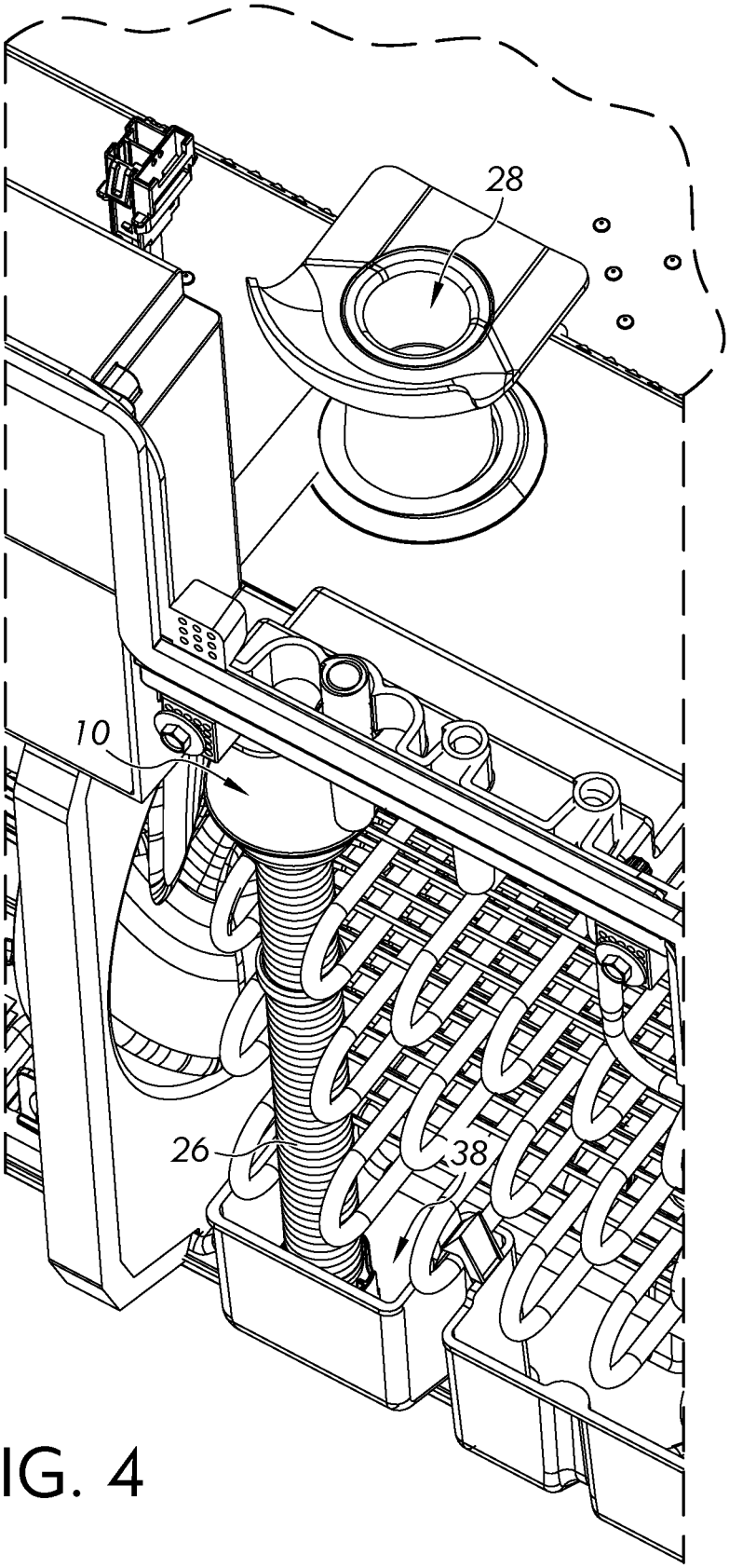
FIG. 4 is a top perspective view of the machine compartment of FIG. 2 with an example appliance drain.

It is to be appreciated that the drain 28 is typically located in the floor or bottom wall of the cooled compartment (any of the freezer compartment or fresh food compartment) at a low point below the evaporator so that the water condensate naturally flows toward the drain 28. The drain 28 is then connected via a suitable length of tubing so that the terminal end of the drain tubing enters the machine compartment. In another example, FIG. 4 is a top perspective view of the machine compartment of FIG. 2 located immediately below an appliance drain 28 (for example, in a single-door freezer, or fresh-food refrigerator). During assembly, the drain 28 is connected to be flush with or recessed into a bottom surface of the cooled compartment so that the water condensate can readily flow therein. Once the cabinet liner is in its final position, an insulating foam is injected in between the liner and the outer walls of the appliance. The foam fills the space between the liner and the machine compartment and surrounds at least a portion of the exterior of the drain tube.

Figure 3:
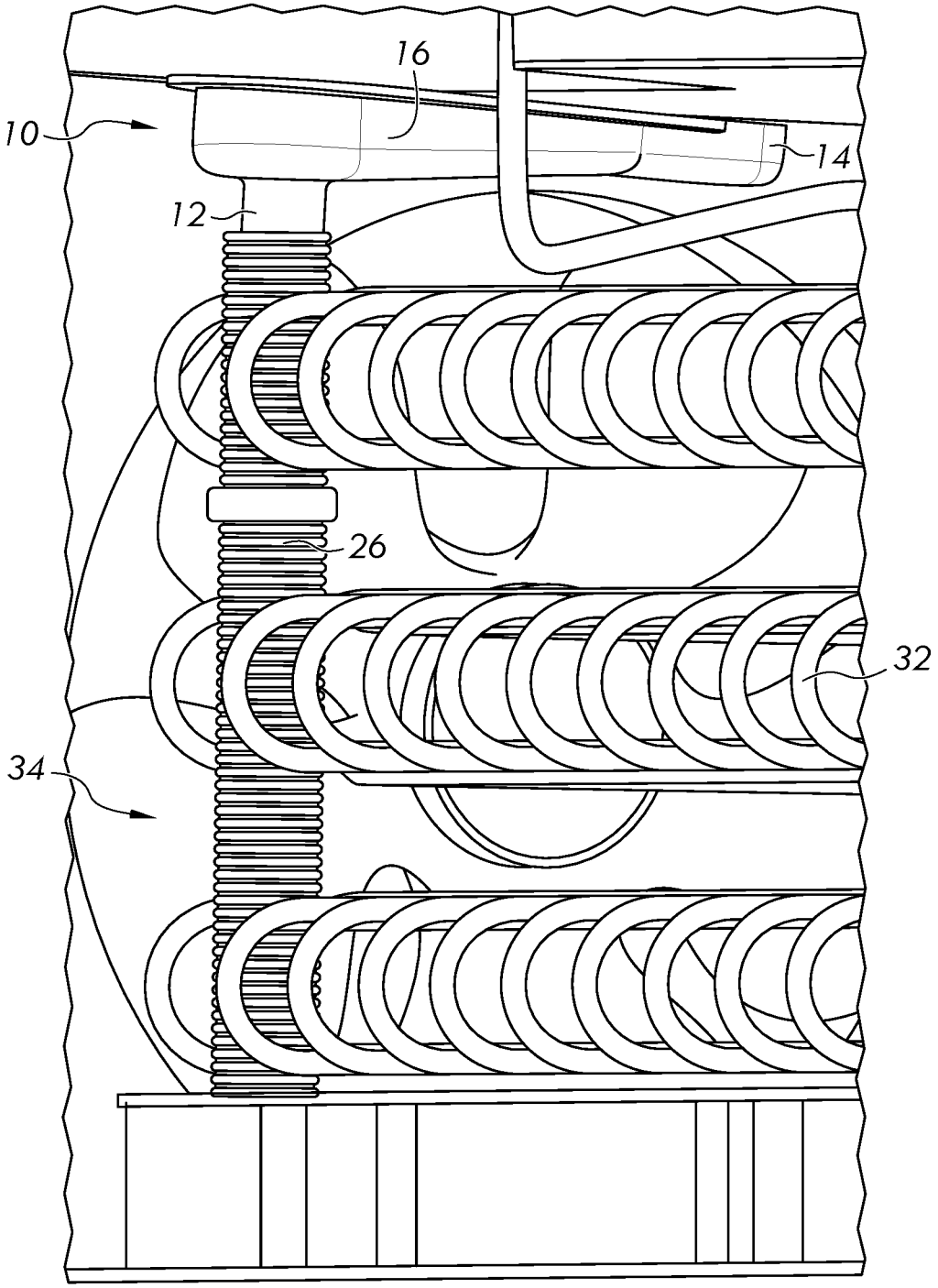
FIG. 3 is a perspective view of the machine compartment of FIG. 2 with an extension tube.

FIG. 3 is a perspective view of the machine compartment of FIG. 2 with an extension tube 26. The drain jumper assembly 10 comprises an inlet 14, a main body 16, and an outlet 12, which together are configured to transfer condensate from the appliance drain 28 (shown in FIG. 4), such as a freezer drain, to a preferred location within the machine compartment.

Figure 5:
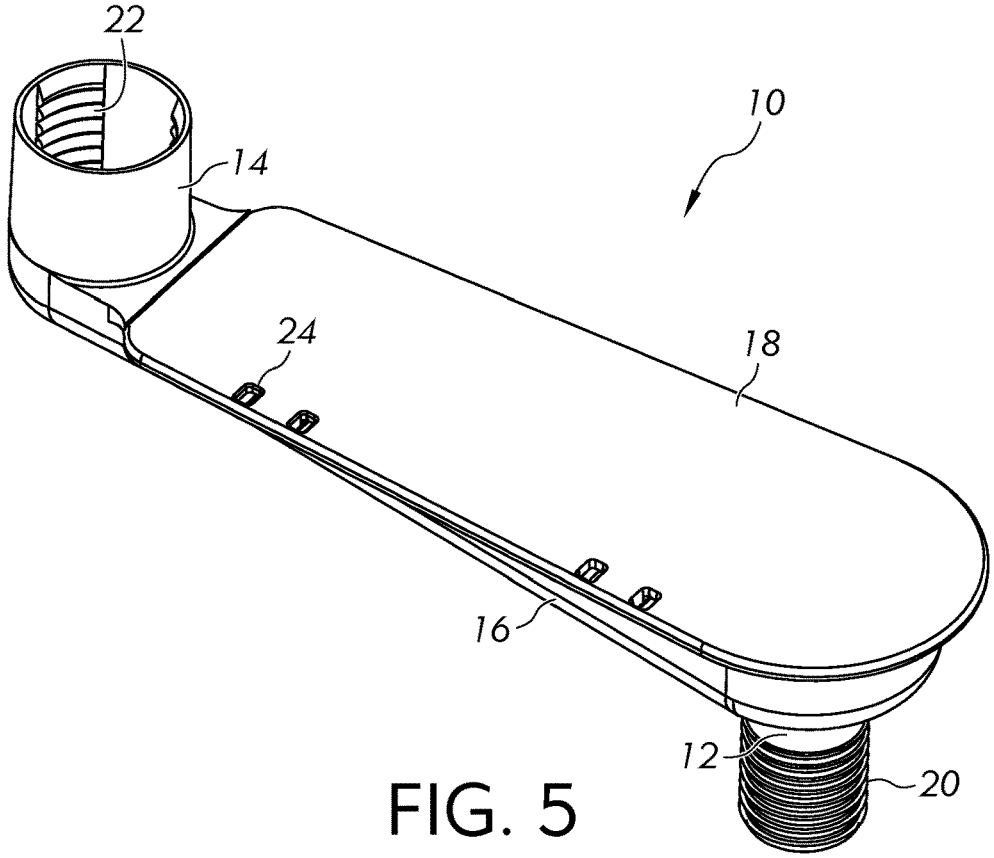
FIG. 5 is a perspective view of the example drain jumper assembly with a lid.

FIG. 5 is a perspective view of a drain jumper assembly 10 with a lid 18. In this embodiment, the drain jumper assembly includes an outlet 12, an inlet 14, a main body portion 16, and a lid 18. The inlet 14 is positioned relatively higher than the outlet 12 so that the main body 16 slopes downward. This configuration allows water to flow by gravity from the inlet 14 to the outlet 12. The main body 16 includes a hollow interior, a downward slope, and a wider portion near the outlet, which all can assist in the flow of water. The lid 18 is used to cover and prevent foreign objects from entering the hollow interior of the main body 16. In one embodiment, the lid 18 is pivotable about a first side of the assembly 10 via at least one hinge. The at least one hinge may be any of the one or combination of the following hinges: a living hinge; a piano hinge; a butterfly hinge; a flush hinge; a barrel hinge; a spring hinge; or any other suitable hinge means. The lid 18 may be connected or attached to the assembly 10. In another embodiment, the lid 18 is secured to a second side of the assembly 10, opposite of the first side, via at least one fastener 24. For example, the lid 18 can be secured to the assembly 10 via one or more fasteners. The at least one fastener may include any one or combination of the following: snaps; clips; hooks; ties; or any other suitable fastening means. The lid 18 can also be removable. In yet another embodiment, the lid 18 can be secured by positioning the assembly 10 adjacent to a top wall of the machine compartment 30. The position of the lid 18 relative to the top wall of the machine compartment 30 is configured to maintain a closed lid position with or without fasteners, and/or to obstruct removal of the lid 18.

Figure 6:
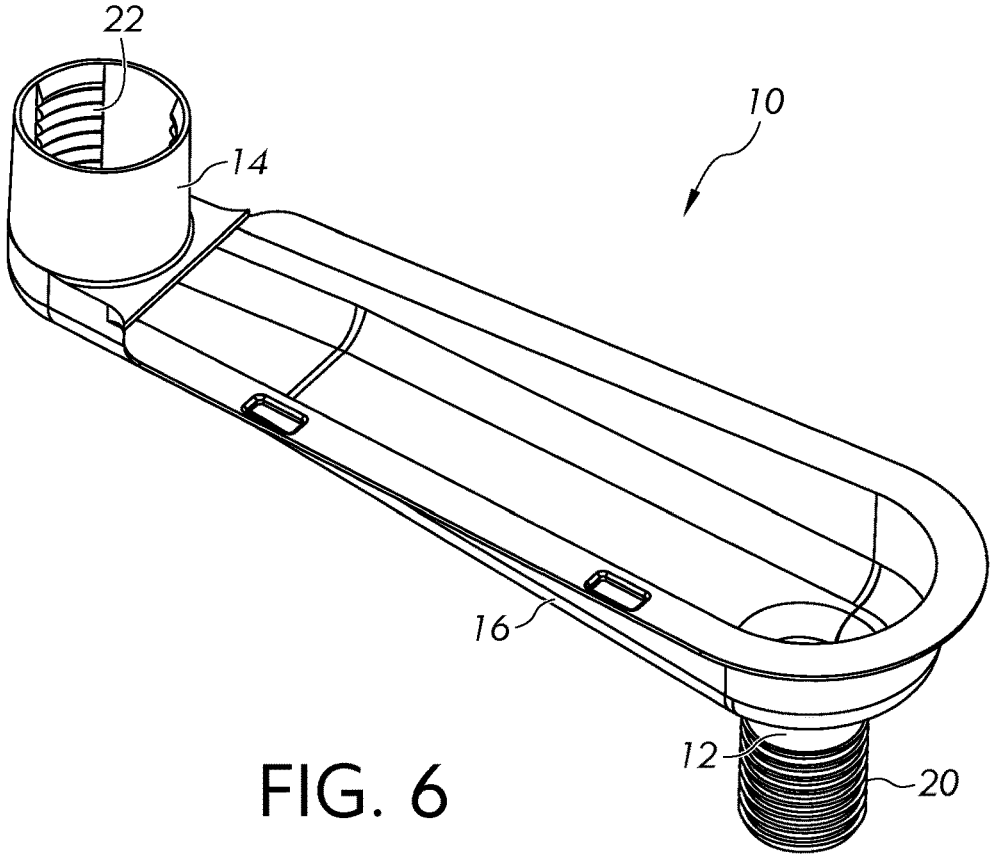
FIG. 6 is a perspective view of another example drain jumper assembly without a lid.

FIG. 6 is a perspective view of a drain jumper assembly 10 without a lid. In this embodiment, the top of the main body 16 can be positioned immediately adjacent to or in abutment with the top of the machine compartment without a separate lid. The position of the main body 16 relative to the top wall of the machine compartment effectively closes off the hollow interior to thereby obviate the need for a separate lid and to cover and prevent foreign objects from entering the main body 16. In yet another embodiment, the distance between the first and second walls of the main body 16 gradually widens from the inlet 14 to the outlet 12. For example, the distance between the first and second walls near the inlet is from 0.5 inches to 1.5 inches, preferably from 0.6 inches to 1.4 inches, more preferably from 0.75 inches to 1.25 inches, and most preferably from 0.9 inches to 1.1 inches. The distance between the first and second walls near the outlet is from 1 inch to 2 inches, preferably from 1.1 inches to 1.9 inches, more preferably from 1.25 inches to 1.75 inches, and most preferably from 1.4 inches to 1.6 inches. In this embodiment, the widening distance between the side walls improves the water flow from the appliance drain 28 to the extension tube 26. In another embodiment, the distance between a first and second side of the lid 18 widens from the inlet 14 to the outlet 12 to correspond with the widening dimensions of the main body 16 and to cover the contents within the main body 16.

As described above, the drain jumper assembly 10 connects between the existing freezer drain 28 and is used to transfer the drain water to a preferred location within the machine compartment. The drain jumper assembly 10 can be connected to each of the appliance drain 28 and the extension tube 26 in a variety of manners, preferably via a removable connection. In one embodiment, the extension tube 26 is secured to the outlet 12 of the drain jumper assembly 10 via an interference fit, which can be airtight. The interference fit can also be tight enough to allow water to travel through without leaking. The outlet 12 can include a first set of ribs 20 (shown in FIGS. 5 and 6) that correspond to a second set of ribs of the extension tube 26. An operator can slide the extension tube 26 over the outlet 12 of the drain jumper assembly 10, which results in a secure connection. The extension tube 26 can also be secured to the outlet 12 via a screw-thread connection, a screw-thread with a rubber gasket connection, a ferrule connection, a compression fitting connection, a coupling connection, or any other suitable connection method. In another embodiment, the inlet 14 of the drain jumper assembly 10 is secured to the appliance drain 28 via interference fit, which can be airtight. The interference fit can also be tight enough to allow water to travel through without leaking. The inlet 14 can include a first set of ribs 22 (shown in FIGS. 5 and 6) that correspond to a second set of ribs of an outlet of the appliance drain 28. The inlet 14 can also be secured to the appliance drain 28 via a screw-threaded connection, a screw-thread with a rubber gasket connection, a ferrule connection, a compression fitting connection, a coupling connection, or any other suitable connection method. The inlet 14 can be secured to the appliance drain 28 and the outlet 12 can be secured to the extension tube 26 by utilizing the same or different connection method.

In yet another embodiment, the drain jumper assembly 10 is configured to swivel or rotate about an axis, such as the central rotational axis, of the appliance drain 28 such that an operator can swivel or rotate the drain jumper assembly 10 to achieve a convenient or easily accessible position for access. For example, the assembly 10 can be rotated to a position where the outlet 12 is located at one of the front or the rear of the machine compartment 30. This embodiment enables an operator to access the drain tube and drain water from a conveniently located position. For example, the extension tube 26 is preferably located at any accessible position for an operator, such as at the front of the machine compartment 30 (i.e., a position readily accessible from the rear of the appliance), or any other accessible location. The extension tube 26 can also be located in front of and/or in between the condenser coils 32 (shown in FIG. 3). In one example, the terminal end of the extension tube 26 can be positioned within a drain pan 44 located below the condenser coils 32 (shown in FIG. 4). The condenser coils 32 radiate latent heat from the evaporative refrigeration process that can help to evaporate the water within the drain pan 44.

Figure 7:
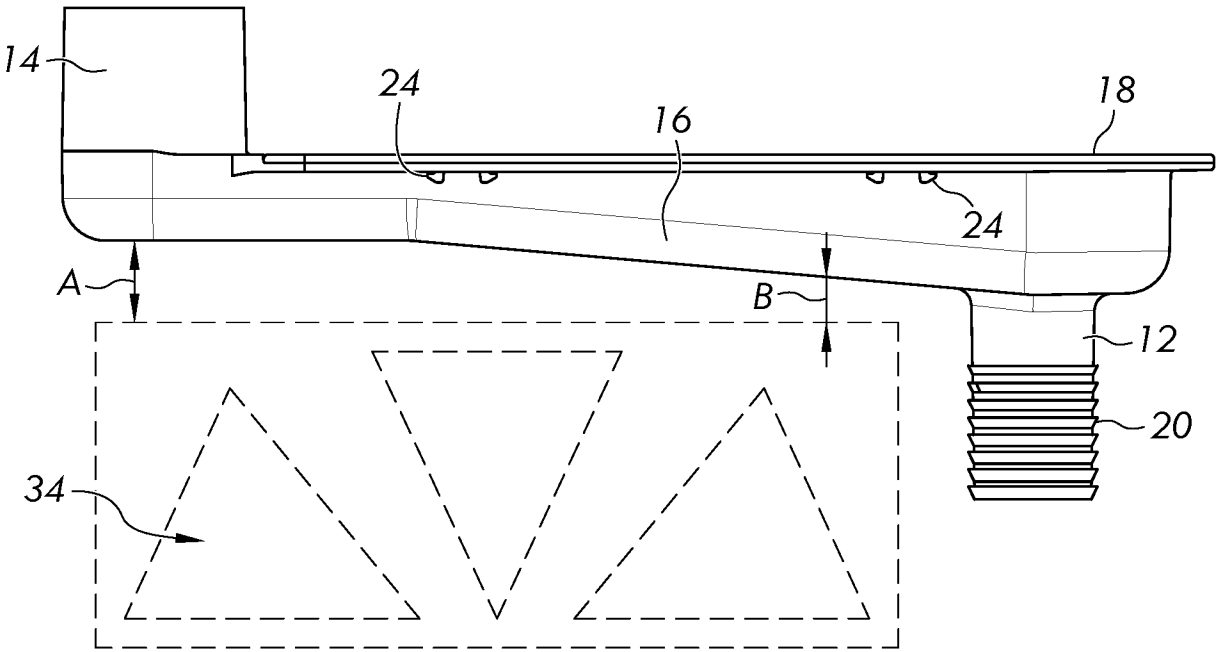
FIG. 7 is a side view of the drain jumper assembly of FIG. 5 positioned near other equipment within the machine compartment.

FIG. 7 is a side view of the drain jumper assembly of FIG. 5 shown next to equipment of the machine compartment. In one embodiment, the bottom wall of the main body 16 includes a substantially flat portion or flat portion near the inlet 14. The bottom of the main body 16 gradually slopes or declines from the flat portion towards the outlet 12 at an angle from about 1° to 20°, preferably from about 2° to 10°, more preferably from about 3° to 7°, and most preferably from about 4° to 6°. This taper enables the water to flow by gravity from the inlet 14 to the outlet 12. In one embodiment, the distance A between the bottom of the main body 16 near the inlet 14, and the fan 34 is greater than the distance B between the bottom of the main body 16 near the outlet 12, and the fan 34. For example, the distance A can be from 0.5 inches to 1.5 inches, preferably from 0.6 inches to 1.4 inches, more preferably from 0.75 inches to 1.25 inches, and most preferably from 0.9 inches to 1.1 inches. The distance B can be from 0.1 inches to 0.9 inches, preferably from 0.25 inches to 0.75 inches, more preferably from 0.3 inches to 0.7 inches, and most preferably from 0.4 inches to 0.6 inches. When a fan, such as the condenser fan, is located adjacent to the main body 16, the tapered bottom surface thereof can interfere or otherwise affect the airflow from the fan 34. The relatively larger distance A at one side of the drain jumper assembly 10 can reduce airflow interference from a fan 34 in the machine compartment 30 to further reduce noise from the machine compartment 30.

Figure 8:
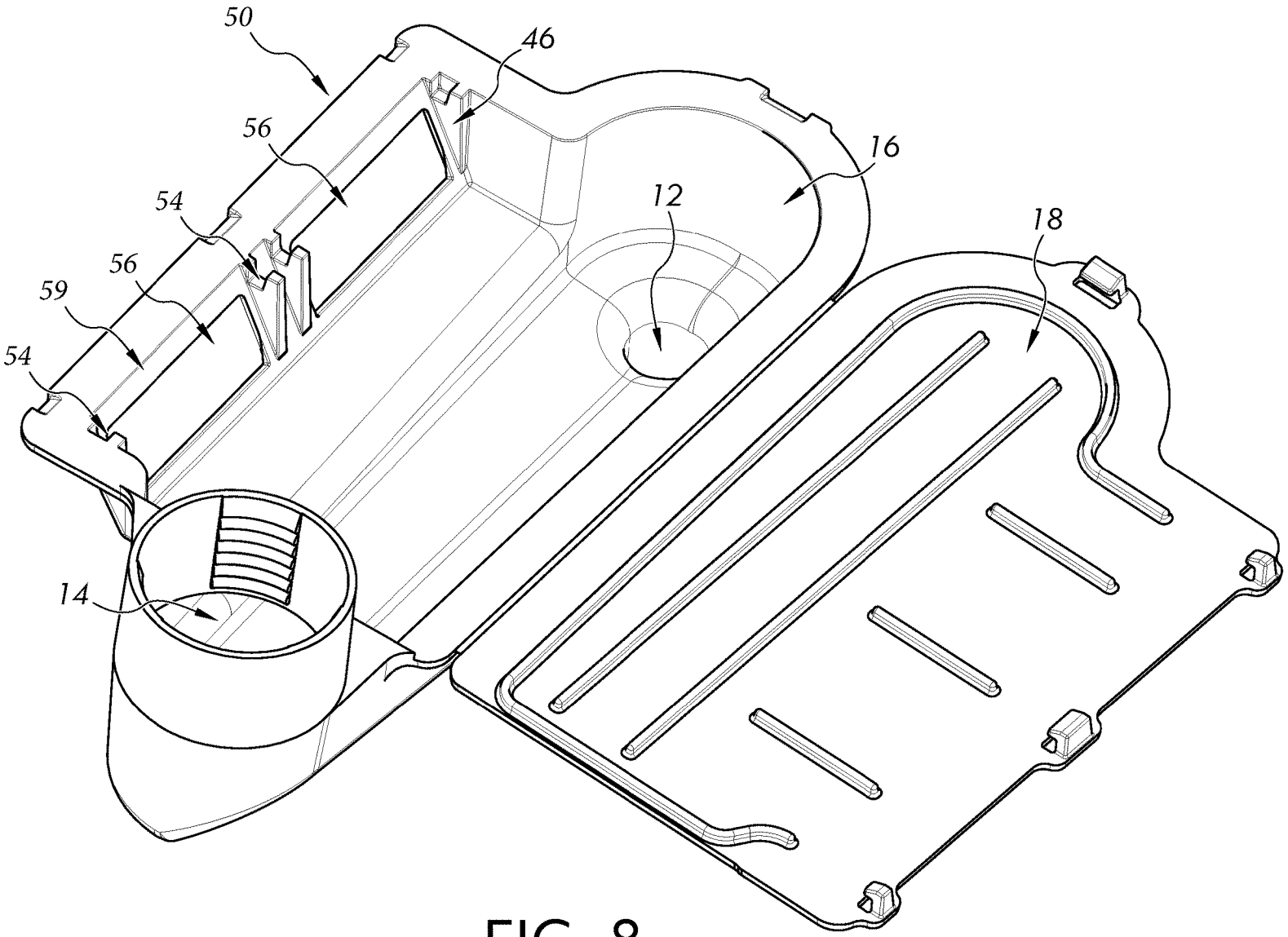
FIG. 8 is a top perspective view of another embodiment of a drain jumper assembly with an example vacuum relief system.
Figure 9:
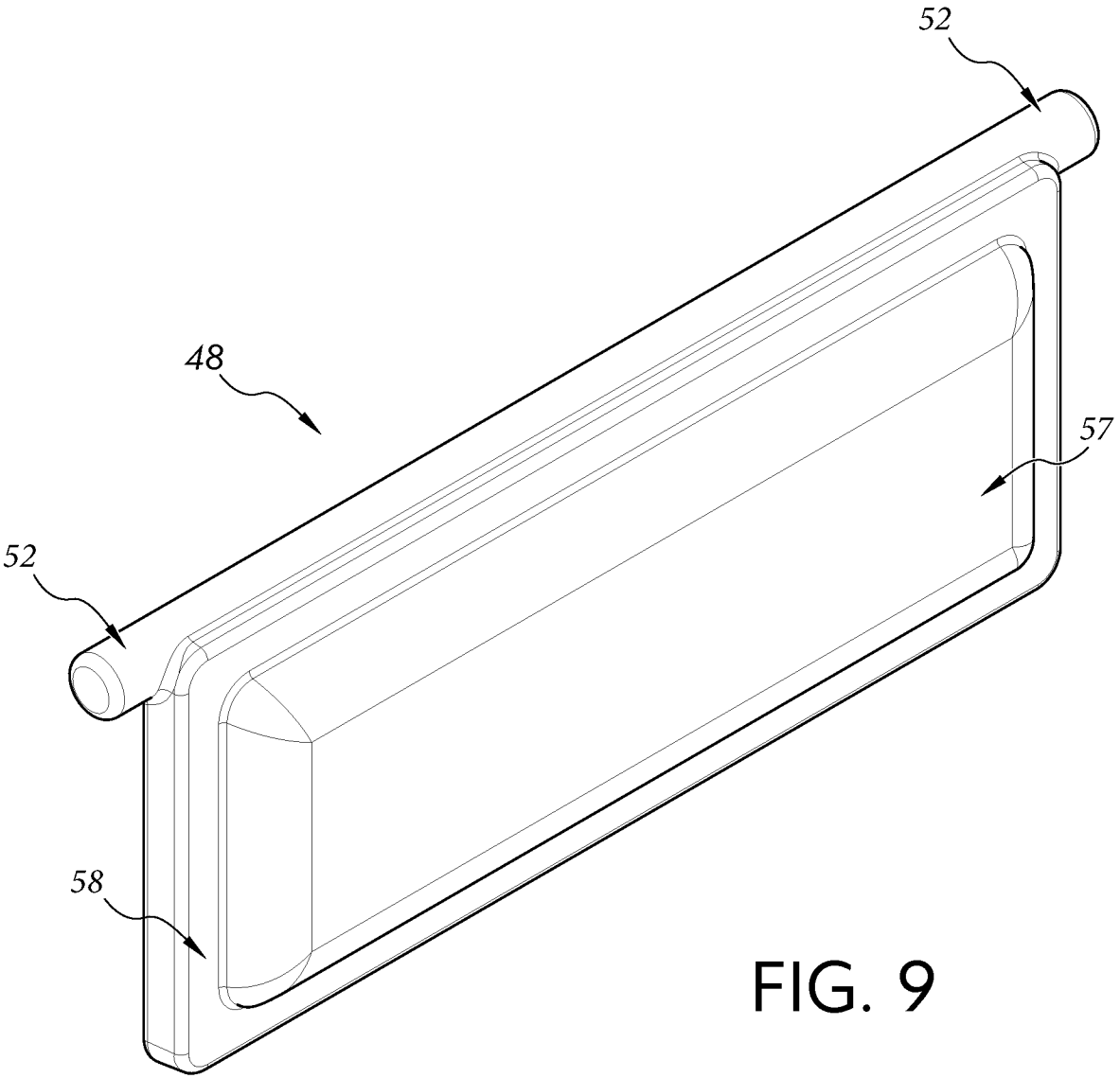
FIG. 9 is a perspective view of a door of the example vacuum relief system for the drain jumper assembly of FIG. 8.

In another embodiment, the drain jumper assembly 10 can include a vacuum relief system 50, as shown in FIGS. 8 and 9. The vacuum relief system 50 includes a pressure relief valve integrally extending from the main body 16 that provides selective fluid communication between the main body and the exterior environment. The vacuum relief system is configured to automatically equalize a pressure differential between an interior of the main body and the exterior environment. The relief valve 46 can be located variously, such as on a side wall of the main body 16. The relief valve 46 includes a side sloped or angled toward the body 16 having at least one moveable relief door 48 configured to be pivotably secured to cover an opening 56 in the side of the relief valve 46. For example, the relief valve 46 can include two or more movable relief doors as shown in FIG. 8, although in other examples only a single door could also be used. As shown in FIG. 9, the relief door 48 can include a raised center portion 57 that is received into the opening 56 when the door is in a closed position. The raised center portion 57 can be surrounded by a flat outer flange 58 that rests upon the interior face 59 of the relief valve 46. The relief door 48 or the interior face 59 can include a seal member (i.e., rubber, silicone, or the like), or the flat outer flange 58 may simply close off the opening 56 via face-to-face contact with the interior face 59.

In one embodiment, the door 48 can be secured via at least one hinge. The at least one hinge may be any of the one or combination of the following hinges: a living hinge; a piano hinge; a butterfly hinge; a flush hinge; a barrel hinge; a spring hinge; or any other suitable hinge means. In yet another embodiment, the door 48 can include two projections 52 that can rest within and rotate relative to corresponding cavities 54 on either side of the relief valve door opening 56. The projections 52 can be cylindrical, or any shape suitable to rotate relative to the cavities 54. The cavities 54 can be rectangular (shown in FIG. 8), cylindrical, or any shape suitable to receive the projections 52. Preferably, the door 48 is configured to open inwardly towards the interior of the main body 16. In this embodiment, the inlet can also include a wider diameter than the inlet 14 without the vacuum relief system 50. For example, the diameter of the inlet 14 can be larger than the diameter of the outlet 12. Further, the bottom of the main body 16 slopes or declines at a greater degree from the flat portion towards the outlet 12 than when the jumper 10 does not include the relief system 50. Additionally, where a vacuum relief system 50 is used, it is preferably located higher than and spaced a distance from the bottom of the main body 16 so that any drain water flowing within the jumper drain does not leak out of the relief door 48.

When an appliance door is opened from a closed position, an undesired vacuum can be created within the appliance, including within the drain jumper assembly 10. Such a vacuum can inhibit the user from re-opening the appliance door. Thus, the vacuum relief system 50 provides a pressure release to the drain jumper assembly 10 when the undesired vacuum is forming. For example, when a vacuum is forming within the appliance and also within the jumper assembly 10, the relief door 48 is automatically pulled open by the force of the forming vacuum pressure. The open door 48, which is in fluid communication with the ambient environment of the machine room, then allows ambient air to enter the jumper 10 and relieve the vacuum pressure. Once the pressure is equalized, the relief door 48 will then return to its normally-closed position. The relief door 48 can be biased towards the normally closed position in various manners. In one example, the relief door 48 can be resiliently biased towards the closed position, such as by a spring or the like. Alternatively, in another example, the relief door 48 can be positioned at an outwardly projecting angle (see FIG. 8) whereby the center of gravity for the relief door 48 is spaced a distance from the rotation axis provided by the cavities 54 so that the door 48 can automatically return to the closed position under the force of gravity once the vacuum within the main body 16 is relieved.

The invention has been described with reference to the example embodiments described above. Modifications and alterations will occur to others upon a reading and understanding of this specification. Examples of embodiments incorporating one or more aspects of the invention are intended to include all such modifications and alterations insofar as they come within the scope of the appended claims.

What is claimed is:

1. A drain extension assembly for an appliance that provides fluid communication between an internal storage compartment and an exterior environment via an appliance drain that collects and transfers liquid condensate from an evaporator, the drain extension assembly comprising:

a main body with an inlet and an outlet, wherein the inlet is configured to be secured to said appliance drain and the outlet is configured to be secured to an extension tube that is configured to discharge said liquid condensate into a drain pan disposed below a condenser, wherein the main body comprises a downward slope extending between the inlet and the outlet, said downward slope including an angle of about 2° to 10°; and a vacuum relief system providing selective fluid communication between the main body and the exterior environment, the vacuum relief system including a pressure relief valve provided at a wall of the main body.

2. The assembly of claim 1, wherein an opening is formed within the wall of the main body, and the pressure relief valve includes a door movably secured to the main body so as to selectively close the opening in order to automatically equalize a pressure differential between an interior of the main body and the exterior environment.

3. The assembly of claim 2, wherein the door is disposed within the interior of the main body.

4. The assembly of claim 2, wherein the door includes an outer flange configured to rest against an interior surface of the wall of the main body.

5. The assembly of claim 4, wherein the door further includes a projection extending outwards therefrom, and wherein the projection is configured to be received within the opening when the outer flange rests against the interior surface of the wall so as to close the opening.

6. The assembly of claim 5, wherein the outer flange is planar and circumscribes the projection.

7. The assembly of claim 2, wherein the door is pivotably secured to the main body and is biased towards a position where the door closes the opening.

8. The assembly of claim 7, wherein the wall is angled outwards from a center of the main body, and wherein a center of gravity of the door is provided at a spaced distance from a pivoting axis about which the door pivots such that the door is biased towards the position wherein the door closes the opening via gravity.

9. The assembly of claim 2, wherein the door includes a pair of opposing projections extending peripherally outwards therefrom, and wherein each projection of the pair of opposing projections is received within a respective cavity provided within the interior of the main body such that the door is pivotably secured to the main body.

10. An appliance comprising:

a cabinet defining a storage compartment;

an evaporative cooling system configured to reduce a temperature of the storage compartment, and comprising an evaporator, a condenser, and a compressor, wherein the evaporator is positioned within the storage compartment, and the condenser and compressor are positioned within a machine compartment located below and external to the storage compartment, the machine compartment being in fluid communication with an exterior environment;

a drain disposed below the evaporator to collect and transfer liquid condensate from the evaporator, the drain providing fluid communication between the storage compartment and the machine compartment; and a drain extension assembly comprising:

a main body having an inlet and an outlet, the inlet being secured to the drain at said machine compartment to receive the liquid condensate from the drain, and the outlet being secured to an extension tube that discharges said liquid condensate into a drain pan, wherein the main body comprises a downward slope extending between the inlet and the outlet, said downward slope including an angle of about 2° to 10°; and a vacuum relief system providing selective fluid communication between the main body and the exterior environment, the vacuum relief system including a pressure relief valve provided at a wall of the main body.

11. The appliance of claim 10, wherein the main body is disposed within the machine compartment and immediately adjacent to a top wall thereof.

12. The appliance of claim 10, wherein an opening is formed within the wall of the main body, and the pressure relief valve includes a door movably secured to the main body so as to selective close the opening in order to automatically equalize a pressure differential between an interior of the main body and the exterior environment.

13. The appliance of claim 12, wherein the door includes an outer flange configured to rest against an interior surface of the wall of the main body.

14. The appliance of claim 13, wherein the door further includes a projection extending outwards therefrom, and wherein the projection is configured to be received within the opening when the outer flange rests against the interior surface of the wall so as to close the opening.

15. The appliance of claim 14, wherein the outer flange is planar and circumscribes the projection.

16. The appliance of claim 12, wherein the door includes a pair of opposing projections extending peripherally outwards therefrom, and wherein each projection of the pair of opposing projections is received within a respective cavity provided within the interior of the main body such that the door is pivotably secured to the main body.

17. The appliance of claim 12, wherein the door is biased towards a position where the door closes the opening.

18. A drain extension assembly for an appliance that provides fluid communication between an internal storage compartment and an exterior environment via an appliance drain that collects and transfers liquid condensate from an evaporator, the drain extension assembly comprising:

a main body defining an interior and having an inlet and an outlet in fluid communication with said interior, wherein the inlet is configured to be secured to said appliance drain and the outlet is configured to be secured to an extension tube that is configured to discharge said liquid condensate into a drain pan disposed below a condenser, and wherein the main body comprises a downward slope extending between the inlet and the outlet, said downward slope including an angle of about 2° to 10°, the main body further including an opening formed in a wall thereof; and a vacuum relief system providing selective fluid communication between the main body and the exterior environment, the vacuum relief system including a pressure relief valve provided at a wall of the main body, the pressure relief valve including a door disposed within the interior and movably secured to the main body so as to selectively close the opening in order to automatically equalize a pressure differential between the interior of the main body and the exterior environment, the door comprising:

a planar outer flange configured to rest against an interior surface of the wall of the main body;

a projection configured to be received within the opening when the outer flange rests against the interior surface of the wall so as to close the opening, the outer flange circumscribing the projection; and a pair of opposing projections extending peripherally outwards from the outer flange, wherein each projection of the pair of opposing projections is received within a respective cavity provided within the interior of the main body such that the door is pivotably secured to the main body.

* * * * *